US006044515A

United States Patent [19]

Zygmont

[11] Patent Number: 6,044,515

[45] Date of Patent: Apr. 4, 2000

[54] APPLICATOR PAD WITH HANDLE

[75] Inventor: Joseph F. Zygmont, Killingworth, Conn.

[73] Assignee: Unilever Home and Personal Care USA, Greenwich, Conn.

[21] Appl. No.: 09/059,506

[22] Filed: Apr. 13, 1998

[51] Int. Cl.[7] ..... A47K 7/02

[52] U.S. Cl. ..... 15/209.1; 15/244.1; 604/385.1

[58] Field of Search ..... 15/104.94, 208, 15/209.1, 210.1, 229.14, 244.1; 132/320; 604/289, 358, 385.1

[56] References Cited

U.S. PATENT DOCUMENTS

| | | | |
|---|---|---|---|
| Re. 26,385 | 5/1968 | Gilchrist | 15/210.1 |
| 2,156,270 | 5/1939 | Smith | 15/209.1 |
| 2,927,335 | 3/1960 | Hammond | 401/184 |
| 2,961,677 | 11/1960 | Zecchini | 401/132 |
| 2,964,772 | 12/1960 | Crawford | 15/244.1 |
| 2,975,453 | 3/1961 | Imhof | 15/210.1 |
| 3,074,099 | 1/1963 | Cameron | 15/229.13 X |
| 3,104,915 | 9/1963 | Perkovich et al. | 300/21 |
| 3,131,410 | 5/1964 | Anderson et al. | 15/244.1 |
| 3,142,855 | 8/1964 | Gilchrist | 15/210.1 |
| 3,221,359 | 12/1965 | Moroni et al. | 401/130 |
| 3,369,267 | 2/1968 | Friedland et al. | 15/104.94 |
| 3,737,939 | 6/1973 | Jones, Sr. | 15/244.2 |
| 3,784,998 | 1/1974 | Jones, Sr. | 15/209.1 |
| 4,053,242 | 10/1977 | Mast, Jr. | 401/6 |
| 4,121,386 | 10/1978 | Perez | 451/524 |
| 4,506,404 | 3/1985 | Clay | 15/244.3 |
| 4,575,891 | 3/1986 | Valentine | 15/210.1 X |
| 4,701,168 | 10/1987 | Gammons | 604/310 |
| 4,829,995 | 5/1989 | Metters | 602/58 |
| 4,893,956 | 1/1990 | Wojcik et al. | 401/130 |
| 4,925,453 | 5/1990 | Kannankeril | 428/364 |
| 5,230,119 | 7/1993 | Woods et al. | 15/209.1 |
| 5,507,906 | 4/1996 | Woods et al. | 156/271 |
| 5,771,524 | 6/1998 | Woods et al. | 15/209.1 |

FOREIGN PATENT DOCUMENTS

| | | | |
|---|---|---|---|
| 607525 | 7/1926 | France . | |
| 4609 | 8/1915 | United Kingdom . | |
| 6160 | 3/1916 | United Kingdom | 15/209.1 |
| WO 91/15983 | 10/1991 | WIPO . | |

*Primary Examiner*—Mark Spisich
*Attorney, Agent, or Firm*—Pennie & Edmonds LLP

[57] ABSTRACT

An applicator for applying or removing material to or from a surface. The applicator has a pad and a backing layer, the backing layer having a folded over section forming a handle. The handle is pivotable along the remainder of the backing layer between an upright position in which the handle may be grasped to facilitate use of the applicator, and a collapsed position in which said handle is folded over against the remainder of the backing layer for storage of the applicator. The handle is provided with a prompt or cue that distinguishes the handle from the remainder of the backing layer to facilitate the gripping and uplifting of the handle into the upright use position.

16 Claims, 4 Drawing Sheets

APPLICATOR PAD WITH HANDLE

FIELD OF THE INVENTION

The present invention relates to an applicator pad with a handle formed thereon. More particularly, the present invention relates to an absorbent applicator pad having a fluid impervious backing with a portion folded to form an integral handle that is movable between a flattened position for storage and an upright position for use.

BACKGROUND OF THE INVENTION

Various disposable pads are known in the art for a variety of uses. In particular, pads may be used to apply materials such as powders, fluid, creams, or foams to a surface, including the human body. For example, pads may be used to apply cosmetic powders, tonics, cleansing fluids, creams, ointments, or lotions to the human skin, or to apply polish or polish remover to fingernails or toenails. Such pads may also be used to polish surfaces, such as fingernails or toenails, or, especially if formed from an absorbent material, to wipe surfaces or to absorb fluids or other materials. For the sake of convenience, such pads are hereinafter referenced as "applicator pads."

Given such uses, it has become desirable to provide such applicator pads, particularly absorbent pads, with a fluid impervious backing layer on the proximal face of the pad material (the "base pad"). Such a backing layer prevents any moisture absorbed by the base pad from passing to and soiling or contaminating the user's hand or fingers which are gripping the applicator pad. Such backing layers have also proven to be quite useful in directing the material being applied by the applicator pad to the proper target area, rather than being diverted to the user's hand or finger which is applying the material. However, the fluid impervious materials that are typically used to form such materials are often relatively slippery. Thus, during application, the user must tightly grip the proximal face of the applicator pad, possibly to the extent that the distal face (the application face that contacts the working surface to be contacted by the applicator pad) is wrinkled by such gripping, thus reducing the usable surface area of the distal face. If the user does not tightly grip the proximal face, then the user risks slipping relative to the applicator pad and potentially completely losing hold of the pad.

One solution to the above-described drawback associated with applicator pads having a fluid impervious backing layer is the provision of a handle on the backing layer. Because the applicator pads are often stacked for storage, it is desirable that the handle be movable between a use position, in which the handle is upright and transverse to the plane of the pad, and a storage position, in which the handle is flattened and substantially coplanar with the plane of the pad. It is further desirable to form the handle from a thin material such that the folded handles do not significantly add to the storage space required to store applicator pads having such handles. Such handles have been formed as either separately attached components formed from a thin material, or as an integral element formed by folding or pinching a portion of the backing layer before securing the backing layer to the pad itself. In either case, the handle is formed from a relatively thin material.

Because the handle is formed from a thin material, and particularly when the handle is formed from a fluid-impervious material such as used to form the backing layer, the user may have difficulty with initially grasping the handle and raising it to an upright, use position. It therefore would be desirable to provide a handle that is readily distinguished from the backing layer of an applicator pad and lifted therefrom into a use position.

SUMMARY OF THE INVENTION

It is therefore an object of the present invention to provide an applicator with a backing layer having an improved handle that is easy to distinguish from the backing layer.

It is a related object of the present invention to provide an applicator with a fluid impervious backing layer having a handle having a different texture from the backing layer yet formed from the same material as the backing layer such that the handle is readily distinguished tactilely from the backing layer.

It is a further related object of the present invention to provide an applicator with a backing layer having a handle formed to facilitate gripping thereof.

It is another object of the present invention to provide an improved method of forming an applicator with a backing layer having a handle thereon, such method facilitating manufacturing of the applicator, reducing raw material required, and providing a more user-friendly applicator.

These and other objects and features are accomplished in accordance with the principles of the present invention by forming an applicator with a pad having a backing layer with a section that is folded over to form a handle. The handle is formed in such a way as to distinguish the handle from the remainder of the backing layer (i.e., the non-folded over portion). Distinguishing features include visual and/or tactile cues or prompts provided on the handle and/or the remainder of the backing layer. The handle may be formed with a plow that maintains a portion of the backing material in a folded configuration before the backing material is applied to the pad material. If desired, the folded material may be further treated, such as sealed together by thermal or sonic bonding, or other means of securing the folded portions together.

These and other features and advantages of the present invention will be readily apparent from the following detailed description of the invention, the scope of the invention being set out in the appended claims.

BRIEF DESCRIPTION OF THE DRAWINGS

The detailed description will be better understood in conjunction with the accompanying drawings, wherein like reference characters represent like elements, as follows.

DETAILED DESCRIPTION OF THE INVENTION

Figure 1:
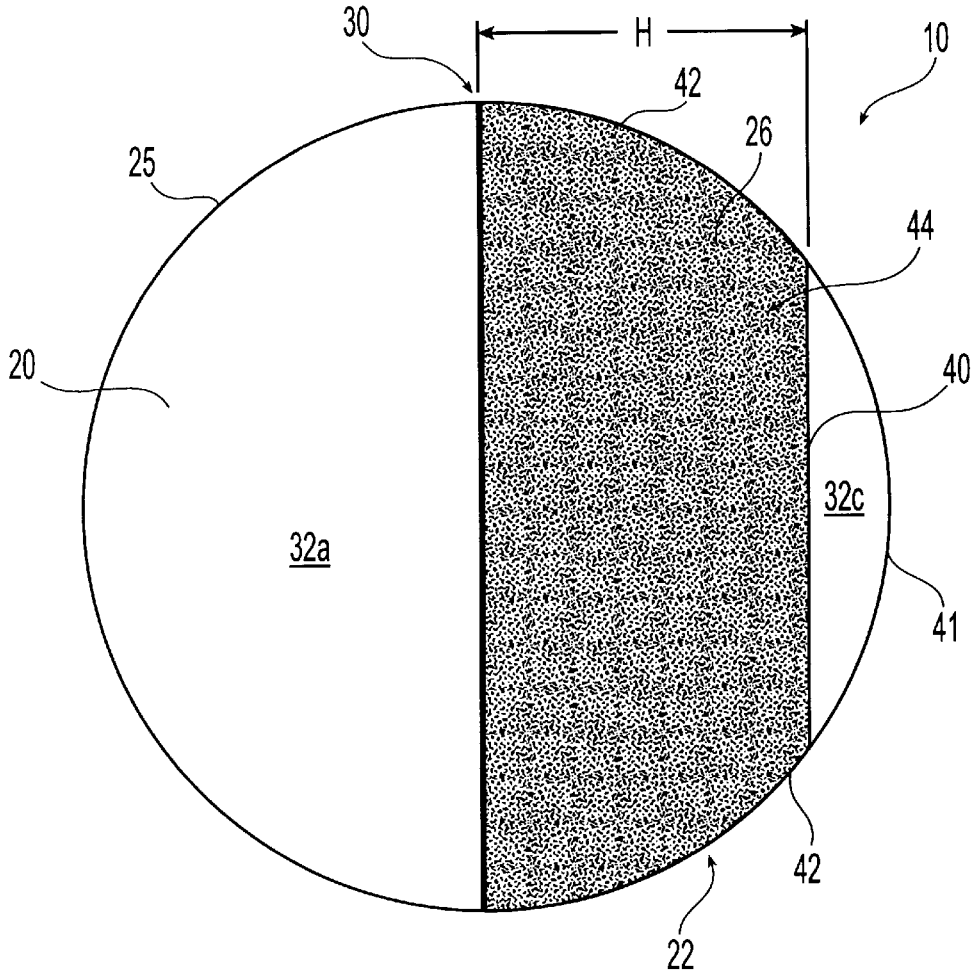
FIG. 1 is a top plan view of an applicator with a handle formed in accordance with the principles of the present invention, the handle being in a storage position.
Figure 2:
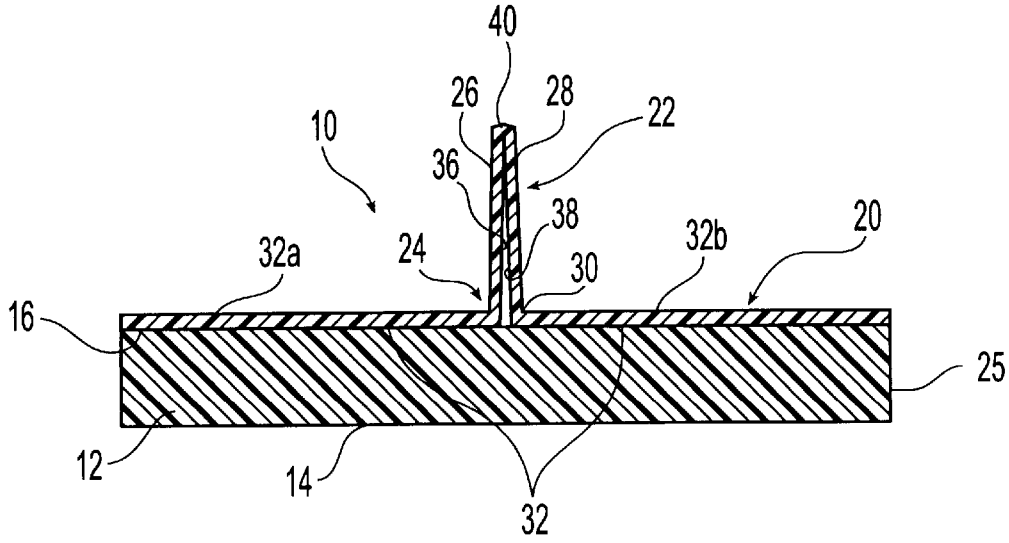
FIG. 2 is a side elevational view of an applicator similar to that of FIG. 1, but with the handle in a use position.

An applicator 10 formed in accordance with the principles of the present invention is shown in FIGS. 1 and 2. Applicator 10 includes a pad 12 having a distal face 14 formed and left exposed to contact the working surface (the surface to be contacted by applicator 10 and to which material is applied by applicator 10 or from which material is removed by applicator 10) and a proximal face 16 formed to be grasped or otherwise held by the user.

Pad 12 is preferably formed from an absorbent material capable of retaining and releasing, as desired, fluids or other materials to be applied by applicator pad 10 or of absorbing fluids or other materials to be removed from a surface with the aid of applicator 10. In particular, the preferred material for the base pad is capable of holding a fluid or solid material and subsequently releasing the fluid or solid material by the application of pressure. Preferably, pad 12 is soft, pliable, absorbent, porous, and substantially lintless. For instance, pad 12 may be formed from a non-woven fiber or synthetic material, such as polyester or rayon, or a synthetic natural fiber blend, such as a polyester-cotton blend; entangled cotton, woven fiber or fabric, abrasive material, gauze, sponge, foam, or other similar, preferably cotton, cotton-polyester, or biodegradable materials. Selection of the material involves consideration of factors such as softness, non-linting, pad integrity, and low abrasivity. The preferred thickness of the pad is from about 0.125 in (0.3175 cm) to about 0.250 in (0.635 cm).

A backing layer 20 is provided on proximal face 16 of pad 12, coupled or secured to pad 12 to remain therewith during use of applicator 10. Distal face 14 is left exposed for contact with a surface to be wiped by applicator 10 or to which materials are to be applied by applicator 10. The material from which backing layer 20 is formed preferably is flexible and wear resistant such that it can be easily coupled to pad 12 and handled during use and withstand vigorous use of applicator 10. In order to protect the user from contact, soiling, or contamination with fluid or other materials absorbed or carried by pad 12, backing layer 20 is preferably formed from a material that prevents any liquids or semi-liquids or other substances and materials absorbed or carried by pad 12 from passing through proximal face 16 of pad 12 to the user and that does not react with materials carried, absorbed, or applied by pad 12. For example, backing layer 20 may be formed from celluloid or a resin or polymeric film, e.g., a fluid impervious barrier film, a thin plastic film material, or sheet-form plastic, such as formed from polyethylene, polyester, polypropylene, and the like; or a paper treated to be impervious, e.g., paper impregnated or coated with a latex, plastic, or resin to render the paper impervious. It is important in choosing or forming layer 20 that it be impervious to the liquid, material, or other substances backing layer 20 will encounter during use. The thickness of backing layer 20 is preferably on the order of about 0.0016 in. (0.40$\mu$) to about 0.0024 in. (0.60$\mu$). The thickness of the material preferably is selected to prevent prevent fluid flow therethrough and yet to not be so thick as to compromise softness, functionality and aesthetics. Backing layer 20 is secured to pad 12 in any desired manner which insures that the two layers remain together during use of applicator 10. For instance, hot melt adhesive, pressure sensitive adhesive, thermal fusion, sonic welding or solvent fusion may be used to secure or bond backing layer 20 to proximal face 16 of pad 12.

In accordance with the principles of the present invention, backing layer 20 is provided with a handle 22 that is formed as an integral part of backing layer 20. In particular, handle 22 preferably is formed by folding over a section 24 of backing layer 20 such that backing layer 20 and handle 22 are formed from a substantially continuous piece of material, a portion of which projects above pad 12 as a handle 22 and the remainder of which is secured to pad 12 and flanks handle 22. Thus, the material used to form backing layer 20 should also be selected to have enough strength to enable the user to properly grip handle 22 and apply the desired force to applicator 10 during use. As may appreciated with reference to FIG. 2, because handle 22 is formed by folding over a section 24 of backing layer 20, handle 22 has a first layer 26 and a second layer 28 extending from backing layer 20 along base 30. In order to stack a plurality of applicators 10, handle 22 is preferably also formed to be folded over along its base 30 from the upright use position into a collapsed position.

Preferably, handle 22 is formed to not extend beyond the boundaries of backing layer 20 such that handle 22 does not extend beyond the outer edges or boundary 25 of applicator 10. In the folded configuration, shown in FIG. 2, one of layers 26, 28 (in FIG. 2, layer 28) faces distally and rests substantially against the remainder 32 of backing layer 20 that is coupled to and substantially always coplanar with pad 12, and the other of layers 26, 28 (in FIG. 2, layer 26) faces proximally and is exposed for grasping by a user to lift the handle into a use position. Thus, when handle 22 is in the folded configuration, remainder 32 of backing layer 20 (the flat, unfolded portion coupled to pad 12) is divided into an exposed section 32*a* (FIGS. 1 and 2) which is not covered by handle 22 and a covered section 32*b* (FIG. 2) against which handle 22 is laid and thus which is covered when handle 22 is in the storage position.

As shown in FIG. 1, base 30 is positioned along a diameter of a substantially disc-shaped or circular applicator 10. However, it will be appreciated that handle 22 may be formed along any section of backing layer 20, preferably within the boundaries of backing layer 20. Thus, base 30 may also be positioned at any location along backing layer 20, preferably within the boundaries of backing layer 20, and not necessarily at a central location as shown in FIG. 1. For instance, base 30 may be positioned along the length of applicator 10 closer to one end than to another end. Thus, one of exposed section 32*a* and covered section 32*b* of remainder 32 of backing layer 20 is larger than the other of sections 32*a*, 32*b*. The provision of a smaller section of backing layer on one side of handle 22 than on the other side compensates for the digital pressure imbalance that would otherwise be created by using one finger (the thumb) on one side of handle 22 (i.e., against one of layers 26, 28) and two fingers (the second and third fingers) on the second side of handle 22 (i.e., against the other of layers 26, 28).

To economize on size and thus permit a greater number of applicators 10 to be stacked, layers 26, 28 preferably lie flat against each other along their entire inner surface areas 36, 38, as may be appreciated with reference to FIG. 2. Although not necessary to achieve the desired flatness and compactness, layers 26 and 28 may be secured together, such as by adhesive or hot melt or heat sealing, along part of or their entire inner surface areas 36, 38. Alternatively, layers 26 and 28 may be pinched together only at base 30 to form a seam along which handle 22 is folded. However, layers 26 and 28 need not be secured together because they are sufficiently maintained in a position relative to each other by virtue of the remainder of backing layer 20 (the portion flanking, but not forming, handle 22) being secured to pad 12. If desired, layers 26 and 28 need not be connected at all, layers 26 and 28 being maintained in close contact by virtue of the connection of backing layer 20 to pad 12 and the positioning of bases 30 of each of layers 26, 28 in close contact. Because layers 26 and 28 may be maintained in close contact with each other by virtue of the fixed position of remainder 32 of backing layer 20, backing layer 20 may be formed from two separate pieces, each piece having an upturned portion forming a respective layer 26, 28 and being joined together (or maintained in close proximity without being actually joined) to form handle 22.

Because handle 22 is formed from the same thin and slippery material from which backing layer 20 is formed, handle 22 may be difficult to lift up from the remainder 32 of backing layer 20. Moreover, because handle 22 is so thin, when handle 22 is in the folded-over, storage position, the proximal layer (in FIG. 1, layer 26) is substantially coplanar with exposed section 32*a* of backing layer 20 (which itself is substantially coplanar with and secured to base pad 12) and may be difficult to distinguish therefrom. This difficulty in distinguishing proximal layer 26 of handle 22 from exposed section 32*a* is further increased by the formation of layer 26 and exposed section 32*a* from the same, continuous, unitary piece of thin material. Thus, in accordance with the principles of the present invention, at least proximal layer 26 of handle 22 is formed or configured to have features which distinguish handle 22 from the remainder 32 of backing layer 20, and particularly from exposed section 32*a*. Such features serve as prompts or cues to the user as to the location and function of handle 22 and may take on any of a variety of forms as will now be described.

Preferably, handle 22 is provided with at least one form of visual and/or tactile prompt to direct the user's attention to and facilitate use of handle 22. For instance, handle 22 may be formed (such as during formation of handle 22 or by subsequent alteration thereof) such that edges 40, 42, extending along the boundary or periphery of handle 22 from one end of base 30 to another end of base 30, are distinguished from the remainder of handle 22. Leading or top edge 40 (the end furthest from base 30 and hence backing layer 20 when handle 22 is in the upright, use position as shown in FIG. 2) thus is also distinguished from adjacent edge 41 of covered section 32*b*. If desired, not only leading edge 40 but also side edges 42 may be distinguished from backing layer boundary 25, in general. In such an embodiment, the user prompt is thus formed along the free edges of handle 22 and distinguishes these edges from the main surface area 44 of handle 22 extending between edges 40 and 42 and base 30.

One manner in which leading edge 40 of handle 22 may be distinguished from adjacent edge 41 is to shorten handle 22 such that leading edge 40 does not reach adjacent edge 41, but, instead, is spaced therefrom. If desired, side edges 42 may be spaced from border 25 of backing layer 20 instead or as well. An exposed prompting section 32c is thus provided adjacent covered section 32*b* and visible when handle 22 covers covered section 32*b*. Such a cue is both visual and tactile in that leading edge 40 (or side edges 42, if so formed) may be both visually and tactilely distinguished from adjacent edge 41 by virtue of its spacing therefrom.

The shortening of handle 22 to leave an exposed prompting section 32*c* both distinguishes and facilitates separation of handle 22 from covered section 32*b*. Such shortening may be accomplished by intentionally folding section 24 of backing layer 20 to form handle 22 so that leading edge 40 of handle 22 is within the border 25 of backing layer 20 (which is secured to base pad 12 and preferably can only be lifted therefrom with difficulty). Alternatively, handle 22 may be cut after being formed to leave an exposed prompting section 32*c* on backing layer 20. Such cutting would leave layers 26, 28 separable along leading edge 40 unless inner surface areas 36, 38 are connected to each other.

Another manner in which any of edges 40 or 42 of handle 22 may be distinguished from adjacent edge 41 or border 25, in general, of backing layer 20, is to mechanically or physically alter the shape of any or all of edges 40 or 42 to provide a tactile and/or visual prompt to the user. For example, a part or all of any or all of edges 40, 42 may be crimped, roughened, matte finish or otherwise textured differently from the main surface area 44 to distinguish edges 40, 42 therefrom and also to facilitate lifting of handle 22 into a use configuration (FIG. 2). Alternatively, or additionally, any or all of edges 40, 42 may be formed or altered to be upturned from main surface area 44 such that a ridge or flange is provided along a part or all of edges 40, 42. Such an upturning of edges 40, 42 may be accomplished by forming a hot seam or other type of crimping process at any location along handle 22.

Instead of focusing the physical distinction of handle 22 along edges 40, 42, main surface area 44 in general may be physically distinguished from backing layer 20. For instance, main surface area 44 of handle 22 may be roughened, stippled, embossed, or otherwise textured such that handle 22 is at least tactilely, if not also visually, distinguished from at least exposed section 32*a* of backing layer 20. Alternatively, or additionally, a coating or other elements or materials may be added to main surface area 44 to achieve a similar result. It will be appreciated that such physical distinction of main surface area 44 should at least be formed on proximal layer 26, but may be formed on distal layer 28 as well, if desired.

Handle 22 may additionally, or alternatively, be distinguished from remainder 32 of backing layer 20, or at least exposed section 32*a*, by being provided with a visual cue, such being a color that is different from the color of any or all other portions of backing layer 20. If desired, indicia, such as words or symbols, may be provided on handle 22 as an alternative or additional visual cue for the user to grasp and lift handle 22 to use applicator 10.

The method of forming applicator 10 in accordance with the principles of the present invention is intended to facilitate manufacturing of applicator 10. Additionally, the method of forming applicator 10 is intended to reduce manufacturing costs such as by simplifying the manufacturing process and by reducing material wastes. The inventive method is illustrated in FIGS. 3 and 4.

Figure 3:
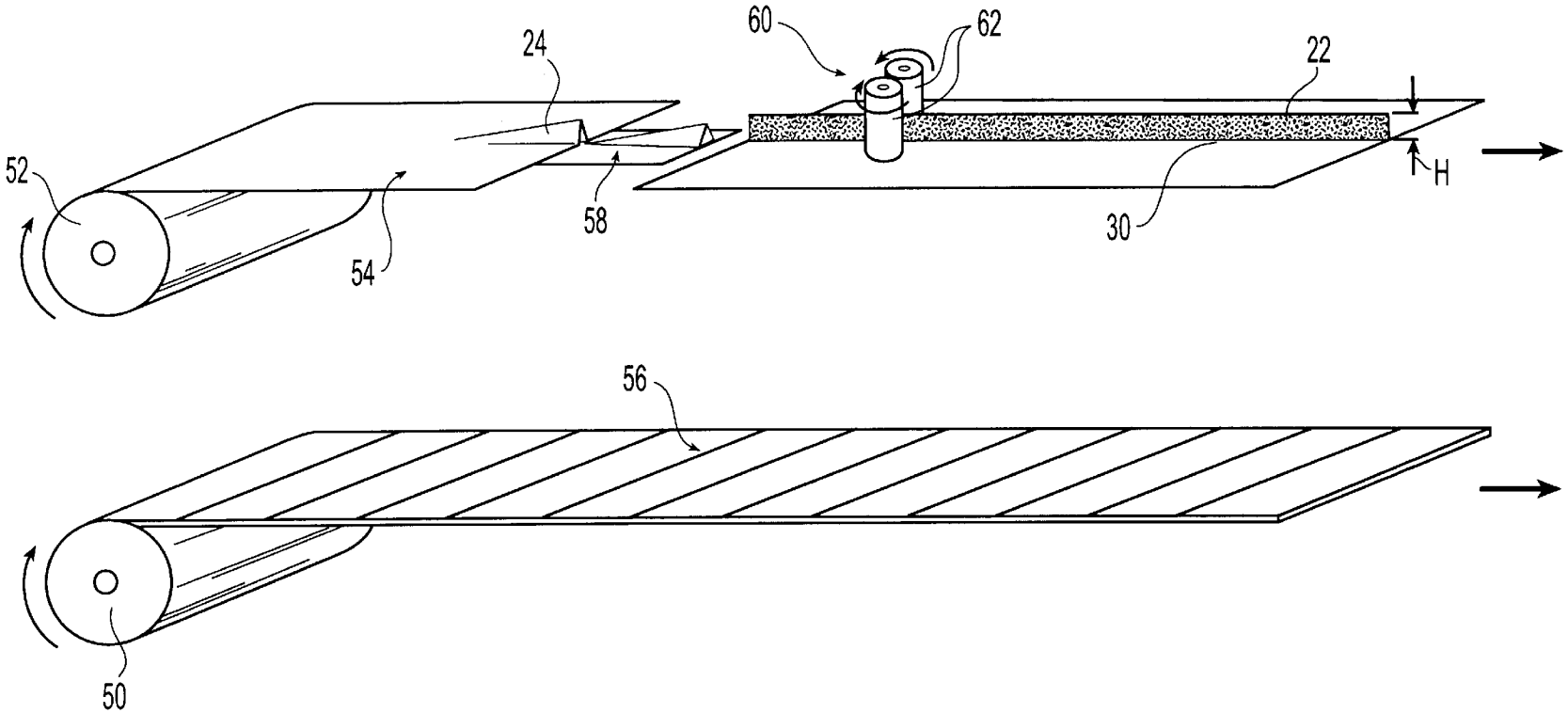
FIG. 3 is a schematic view of a method of manufacturing the layers of an applicator in accordance with the principles of the present invention.
Figure 4:
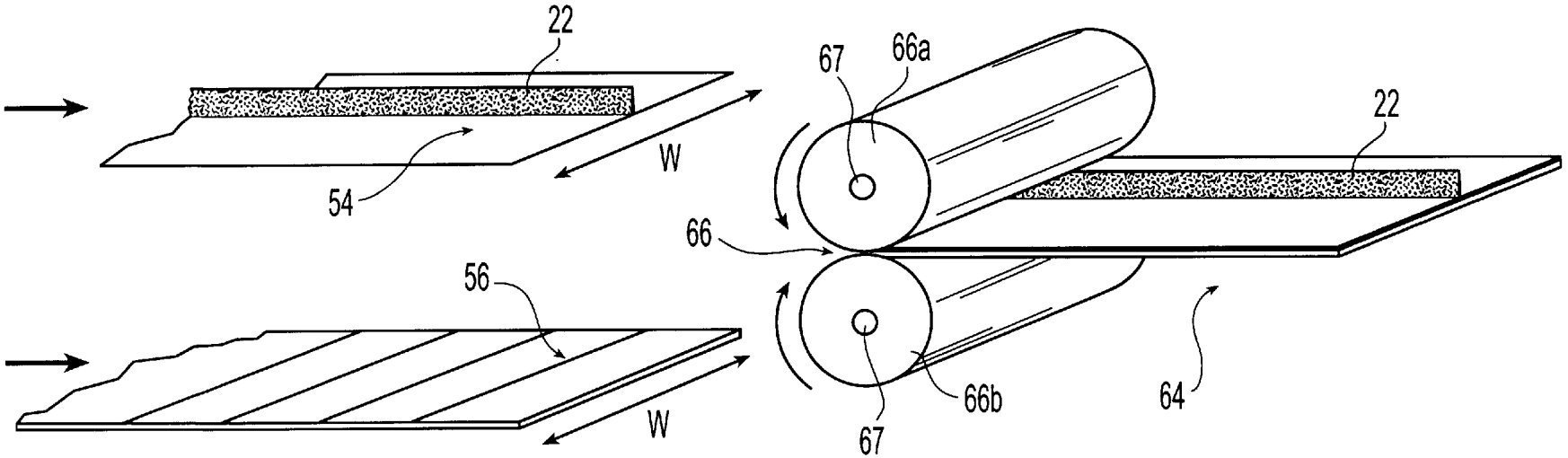
FIG. 4 is a schematic view of a method of joining the layers shown in FIG. 3 to form an applicator in accordance with the principles of the present invention.

Preferably, as shown in FIG. 3, the materials from which pad 12 and backing layer 20 are formed are provided in a compact form to reduce work space and machine size. For instance, the pad and backing layer materials may be provided as material layers 54, 56 wound about respective rolls 50, 52, as shown in FIG. 1. Preferably, the pad and backing material layers 54, 56 are processed alongside each other (to reduce work space and machine size) and simultaneously (to reduce production time), as shown in FIG. 3. Material layers 54, 56 are extended, such as along a conveyor, to be carried through the various processing stations necessary to form a finished applicator 10 in accordance with the principles of the present invention.

In order to form handle 22 from backing layer 20 in an economical and efficient manner, a folding plow 58, is provided at the desired location along backing material layer 54. The height of plow 58 is selected to form a handle 22 having dimensions that preferably provide a visual and/or tactile prompt as described above. For instance, plow 58 may be selected to form a handle 22 having a height H shorter than the distance from base 30 to the edge of the section backing layer 20 secured to pad 12 upon complete processing of applicators 10.

A set of pressing wheels 60 may be provided, preferably in the plane of backing material layer 54 and rotating about rotational axes 62 perpendicular to backing material layer 54, to maintain layers 26, 28 of handle 22 in a substantially upright position to form handle 22 and prevent folded over section 24 of backing material layer 54 from flattening back into the plane of material layer 54 (and thereby eliminating handle 22). If layers 26, 28 of handle 22 are to be joined together, wheels 60 may be thermal setting or adhesive applying wheels or any other type of wheels that would adhere, fuse, bond, or otherwise secure layers 26, 28 together in any desired manner. Such wheels 60 are preferably used to form handle 22 before backing layer 20 is secured to pad 12, for benefits as will be detailed below.

As shown in FIG. 4, once handle 22 has been formed, material layers 54, 56 are coupled or secured together, such as by hot melt adhesive, pressure sensitive adhesive, thermal fusion, sonic welding, or solvent fusion, to form a combined web 64 from which applicator pad 10 may be cut. Suitable bonding between the backing material and the base pad can be achieved with a non-reactive bonding, such as a mechanical bonding between the materials, including electromagnetic bonding. Any conventional adhesive that provides sufficient bonding of the backing layer and pad and which is substantially non-reactive with, and does not degrade upon exposure to, the materials to which applicator 10 is exposed may be used. When handle 22 is formed before the backing layer is secured to the pad, the securing of the backing layer to the pad maintains the shape of handle 22, as described above, because of the now fixed relation between the backing layer and pad. Thus, less adhesive, or a one less adhering or securing step is needed if the two layers of handle 22 are not to be otherwise maintained together.

Although adhesive or another bonding material may be applied to one or both of material layers 54, 56 to join material layers 54, 56 together, preferably bonding wheels 66 are provided instead. Wheels 66 perform a securing step, such as application of a hot melt adhesive, a pressure sensitive adhesive, or a thermal bond between material layers 54, 56, to secure the two material layers together such that a two-layer applicator may be cut therefrom. Also, sonic welding can be used as another way to bond layers 54, 56 together. Wheels 66 may be formed in any desired manner, preferably such that bonding wheels 66 have horizontal axes of rotation 67 and are positioned to press all or substantially all of backing material layer 54 against pad material layer 56 to form combined material layer 64. For instance, wheels 66 may include first and second wheels 66*a*, 66*b*, the first, upper wheel 66*a* positioned above material layers 54, 56 to press against pad material layer 56, and the second, lower wheel 66*b* positioned below material layers 54, 56 to press against backing material layer 54. Wheels 66*a* and 66*b* preferably extend across the width W of material layers 54, 56. Because handle 22 is formed in and extends upwardly from backing material layer 54, upper wheel 66*a* preferably is provided with a groove or space shaped to accommodate handle 22. Alternatively, a pair of upper wheels may be provided, one on each side of and flanking handle 22. Each such upper wheel preferably is dimensioned to completely extend across backing material layer 54 from one of the sides of handle 22.

Once the backing layer material, with the handle, is secured to the pad material, the combined material layers may be die-cut to form an applicator of any desired plan shape. Preferably, the manufacturing process includes a step in which the handle of the applicator is folded down, either before or after the applicator is die-cut from the combined material layer (i.e., the material layer formed from the backing material layer secured to the pad material layer). Thus, the applicators formed by the manufacturing method of the present invention are packed with folded or collapsed handles to increase the number of pads that may be packaged together.

While the foregoing description and drawings represent the preferred embodiments of the present invention, it will be understood that various additions, modifications and substitutions may be made therein without departing from the spirit and scope of the present invention as defined in the accompanying claims. In particular, it will be clear to those skilled in the art that the present invention may be embodied in other specific forms, structures, arrangements, proportions, and with other elements, materials, and components, without departing from the spirit or essential characteristics thereof. One skilled in the art will appreciate that the invention may be used with many modifications of structure, arrangement, proportions, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being indicated by the appended claims, and not limited to the foregoing description.

What is claimed is:

1. An applicator for applying or removing materials to or from a surface, said applicator comprising:

(a) a flexible pad of porous absorbent material having a first side exposed for contact with a surface and a second side;

(b) a handle member attached to said second side of said flexible pad, said handle member comprising a flexible, impervious backing layer which is partially folded over to form a double-layered section adapted to be gripped between a user's fingers, the remainder of said backing layer being single-layers that are bonded to said second side of said flexible pad in positions flanking said double-layered section;

wherein:

said double-layered section is pivotable between a collapsed position adjacent a single layer of said backing layer to facilitate packaging or storage of said applicator, and an upright position for gripping between a user's fingers to enable bringing said first, exposed side of said flexible pad into contact with a surface;

said handle member being attached to the remainder of said backing layer along a base portion located such that when pivoted into said upright position, said handle member extends across the top surface of said backing layer between sections of relatively lesser and greater areas of said backing layer;

whereby upon grasping said handle member in said upright position, the user's thumb may be positioned adjacent said lesser surface area and one or more of the user's other fingers may be positioned adjacent said greater surface area to provide balanced forces against said applicator pad during use.

2. An applicator according to claim 1, wherein said backing layer is a film impervious to liquid and semi-liquid substances.

3. An applicator according to claim 1, wherein said double-layered section is provided at least in part with a textured surface or matte finish, said textured surface or matte finish serving to prompt and facilitate gripping and uplifting of said double-layered section to prepare said applicator for use on a surface.

4. An applicator according to claim 3, wherein said textured surface is formed by one of roughening, crimping, stippling, embossing, matting, and coating said backing layer to enhance grippability of said handle member by a user's fingers.

5. An applicator according to claim 4, wherein:

said handle member has a leading edge at a point furthest from said base portion along which said handle member pivots; and said roughening, crimping, stippling, embossing, or coating is formed along at least a portion of said handle member between said leading edge and said base portion.

6. An applicator according to claim 4, wherein:

said handle member has free edges extending along the boundary of said handle member from one end of said base portion along which said handle member pivots to another end of said base portion; and said roughening, crimping, stippling, or embossing is formed along said free edges of said handle member.

7. An applicator according to claim 1, wherein said double-layered section is provided at least in part with a colored surface, said colored surface serving to prompt and facilitate gripping and uplifting of said double-layered section to prepare said applicator for use on a surface.

8. An applicator according to claim 7, wherein said double-layered section is provided at least in part with a textured surface or matte finish, said textured surface or matte finish serving to prompt and facilitate gripping and uplifting of said double-layered section to prepare said applicator for use on a surface.

9. An applicator according to claim 1, wherein part of the double-layered section is cut away to expose to the user's view a corresponding part of an underlying section of said backing layer when said double-layered section is in said collapsed position, thereby facilitating the user's perception and pivoting of said double-layered section from said collapsed to said upright position.

10. An applicator according to claim 1, wherein:

said applicator is disc-shaped; and said base portion is located offset from a diameter of said disc-shaped applicator such that when pivoted into said upright position, said handle member extends across the top surface of said backing layer between sections of said backing layer having semi-disc-like shapes of relatively lesser and greater areas.

11. An applicator according to claim 10, wherein a portion of said double-layered section is cut away along a line comprising a chord of a circle defined by said disc-shaped applicator, thereby enhancing the viewer's perception and pivoting o f said double-layered section from said collapsed to said upright position.

12. An applicator according to claim 11, wherein said chord is parallel to the diameter of said disc-shaped applicator.

13. An applicator according to claim 1, wherein said layers of said double-layered section are bonded together by thermal fusion.

14. An applicator according to claim 1, wherein said single layers are bonded to said second side of said flexible pad by a means comprising hot melt adhesive, pressure sensitive adhesive, thermal fusion, or solvent fusion.

15. An applicator according to claim 1, wherein:

said double-layered section is provided with means effective for prompting and facilitating the gripping and uplifting of said section to prepare said applicator for use on a surface.

16. An applicator according to claim 1, wherein said greater area of said backing layer is sized to permit the user to apply first and second fingers thereon and the lesser area of said backing layer is sized to permit the user to apply the thumb thereon without creating an imbalance of forces with respect to said applicator and its pad during use.

* * * * *